US011066966B2

(12) United States Patent
Li

(10) Patent No.: US 11,066,966 B2
(45) Date of Patent: Jul. 20, 2021

(54) DEVICE FOR ADJUSTING CAMSHAFT PHASE

(71) Applicant: Schaeffler Technologies AG & Co. KG, Herzogenaurach (DE)

(72) Inventor: Xin Li, Suzhou (CN)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 16/954,239

(22) PCT Filed: Dec. 18, 2017

(86) PCT No.: PCT/CN2017/116854
§ 371 (c)(1),
(2) Date: Jun. 16, 2020

(87) PCT Pub. No.: WO2019/119182
PCT Pub. Date: Jun. 27, 2019

(65) Prior Publication Data

US 2020/0308996 A1 Oct. 1, 2020

(30) Foreign Application Priority Data

Dec. 18, 2017 (WO) ..... PCT/CN2017/116854

(51) Int. Cl.
*F01L 1/344* (2006.01)
*F01L 1/02* (2006.01)

(52) U.S. Cl.
CPC ..... *F01L 1/3442* (2013.01); *F01L 1/024* (2013.01); *F01L 2001/34479* (2013.01)

(58) Field of Classification Search
CPC ..... F01L 1/024; F01L 1/3442; F01L 2001/34479; F01L 1/46; F01L 2250/04
USPC ..... 123/90.15, 90.17, 90.31, 90.37
See application file for complete search history.

(56) References Cited

U.S. PATENT DOCUMENTS 5,638,782 A * 6/1997 Eguchi ..... F01L 1/34406 123/90.17
5,845,615 A * 12/1998 Nakamura ..... F01L 1/3442 123/90.17
2005/0145208 A1* 7/2005 Wierl ..... F01L 1/3442 123/90.17
2006/0260578 A1 11/2006 Boese et al.
(Continued)

FOREIGN PATENT DOCUMENTS

CN 101196131 A 6/2008
CN 201786408 U 4/2011
CN 104791037 A 7/2015
(Continued)

*Primary Examiner* — Jorge L Leon, Jr.
(74) *Attorney, Agent, or Firm* — Matthew V. Evans

(57) ABSTRACT

A device for adjusting camshaft phase is proviced that includes a stator, a rotor and two guard caps that limit the rotor are fixedly provided at axial ends of the stator. The device further includes a belt pulley that is sleeved on the periphery of the stator and the guard caps and fixedly connected to the stator or the guard caps. An annular seal is disposed on the device and includes a first sealing portion and a second sealing portion located at axial ends. The seal body is fixedly provided between the stator, the guard caps and the belt pulley, and the annular seal encloses a sealed cavity. The stator, the rotor and the guard caps are fixedly provided in the sealed cavity.

20 Claims, 10 Drawing Sheets

(56) References Cited

U.S. PATENT DOCUMENTS

| | | | | |
|---|---|---|---|---|
| 2010/0064996 | A1* | 3/2010 | Lichti | F01L 1/3442 123/90.17 |
| 2015/0240674 | A1* | 8/2015 | David | F01L 1/352 123/90.15 |

FOREIGN PATENT DOCUMENTS

| | | | | |
|---|---|---|---|---|
| CN | 105927308 | A | 9/2016 | |
| DE | 102010011818 | A1 | 9/2011 | |
| DE | 102017120987 | A1 * | 3/2019 | F01L 1/352 |
| JP | 2002021513 | A | 1/2002 | |

* cited by examiner

DEVICE FOR ADJUSTING CAMSHAFT PHASE

CROSS-REFERENCE TO RELATED APPLICATIONS

This application is the U.S. National Phase of PCT Application No. PCT/CN2017/116854 filed on Dec. 18, 2017, the entire disclosure of which is incorporated by reference herein.

TECHNICAL FIELD

The present disclosure relates to the technical field of automobiles, in particular to a device for adjusting camshaft phase of an internal combustion engine.

BACKGROUND

The device for adjusting camshaft phase is usually used in the valve train of the internal combustion engine to change the valve opening and closing time, thereby improving the fuel consumption value and operating characteristics of the internal combustion engine.

The device for adjusting camshaft phase includes a stator and a rotor provided in the stator. Among them, the stator is connected to the crankshaft of the internal combustion engine through a chain or a belt, and the rotor is fixedly connected the camshaft of the internal combustion engine. The inner circumferential surface of the stator is provided with a plurality of circumferentially distributed hydraulic chambers; the outer circumferential surface of the rotor is provided with a plurality of circumferentially distributed blades, which are arranged in the hydraulic chambers and are suitable for the movement in the hydraulic chambers depending on different oil pressures, so as to adjust the angle between the stator and the rotor, thereby achieving the adjustment of the timing of valve opening and closing.

During the working process, the hydraulic chamber of the stator is filled with hydraulic oil. If the drive between the camshaft and crankshaft is a dry belt drive, the hydraulic oil should be prevented from flowing out and contacting the belt. In the prior art, in order to prevent the hydraulic oil from flowing out of the stator, it is necessary to perform resin infiltration treatment on the stator molded by powder metallurgy to solve the problem of hydraulic oil leakage.

However, the above treatment method will greatly increase the manufacturing cost, and at the same time other seals are required for auxiliary sealing, resulting in a complicated structure and high requirements on the process.

SUMMARY

The present disclosure aims to solve the problems in the prior art that the method of preventing hydraulic oil from leaking to the outside will greatly increase the manufacturing cost; moreover, the structure is complicated, and the process requirements are higher.

In order to solve the above problems, the present disclosure provides a device for adjusting camshaft phase, including:

a stator and a rotor provided in the stator;

two guard caps that are fixedly provided at axial ends of the stator respectively, and limit the rotor between the two guard caps;

a belt pulley that is sleeved on the periphery of the stator and the guard caps, and fixedly connected the stator or the guard caps;

the device for adjusting camshaft phase further comprising: an annular seal having a seal body and a first sealing portion and a second sealing portion located at the axial ends; and, the seal body is fixedly arranged between the stator, the guard cap and the belt pulley, and respectively extends beyond the first sealing portion and the second sealing portion in the axial direction.

Optionally, the annular seal includes a first seal and a second seal arranged sequentially in the axial direction; and, the first seal has a first sealing portion, the second seal has a second sealing portion, and the first seal and the second seal are connected in a sealed manner to enclose a sealed cavity.

Optionally, the first seal and the second seal are in contact seal or weld seal.

Optionally, the first seal and the second seal are snugly sealed, and there are at least two sealed fitting surfaces between the first seal and the second seal.

Optionally, the device for adjusting camshaft phase further includes a belt pulley, the belt pulley is disposed at the periphery of the stator, and the first seal is radially pressed between the belt pulley, the stator and the guard cap.

Optionally, the second seal is radially pressed between the belt pulley, the stator, and the guard cap to achieve contact sealing between the first seal and the second seal.

Optionally, at least one of the first seal and the second seal is welding fixed to the belt pulley.

Optionally, a protrusion is provided on one radially opposed surface of the belt pulley, the stator and the guard cap, and the other surface is provided with a groove, and the protrusion is provided in the groove.

Optionally, the protrusion is provided on the inner circumferential surface of the belt pulley, and the height of the protrusion gradually increases from one axial end to the other end of the belt pulley.

Optionally, the guard cap includes a first guard cap and a second guard cap, the first guard cap and the second guard cap both extend beyond the outer circumferential surface of the stator in the radial direction; and, the groove is provided on at least one of the first guard cap and the second guard cap.

Optionally, at least one of the first sealing portion and the second sealing portion is provided with a hole, and the hole is adapted to cooperate with the supporting structure to form a seal.

Compared with the prior art, the technical solution of the present disclosure has the following advantages.

The device for adjusting camshaft phase includes a stator, a rotor provided in the stator, and two guard caps fixedly arranged at axial ends of the stator. By providing an annular seal, the annular seal encloses a sealed cavity, and the stator, the rotor and the guard caps are fixedly arranged in the sealed cavity. Therefore, even if the hydraulic oil provided in the hydraulic chamber between the stator and the rotor leaks through the gap between the guard cap and the end surface of the stator, or through the stator made by powder metallurgy, the hydraulic oil cannot leak to the outside through the annular seal. Therefore, it will not contact the external belt, and will not affect the transmission efficiency and lifetime of the belt to the camshaft and crankshaft.

According to the present disclosure, it is not necessary to perform resin infiltration treatment on the stator molded by powder metallurgy, which will not greatly increase the cost;

moreover, the sealing is in a simple form, no other seals are needed for auxiliary sealing, and the manufacturing process requirements are reduced.

Further, the device for adjusting camshaft phase further includes a belt pulley, the belt pulley is disposed at the periphery of the stator, and the second guard cap extends beyond the outer circumferential surface of the stator in the radial direction and is disposed opposite to the belt pulley. The first connection portion and the second connection portion that are arranged radially and oppositely to each other are pressed radially between the belt pulley and the second guard cap. Therefore, the interference fit of the belt pulley and the second guard cap makes the belt pulley fixedly connected the second guard cap and the stator. The driving medium such as belt, etc., drives the stator to rotate through driving the belt pulley to rotate, so as to drive the crankshaft of the internal combustion engine to rotate. At the same time, the radial bonding force between the first connection portion and the second connection portion is increased, so that the first connection portion and the second connection portion have a better sealing effect.

DETAILED DESCRIPTION

In order to make the above objects, features and advantages of the present disclosure more obvious and understandable, specific embodiments of the present disclosure will be described in detail below with reference to the drawings.

The First Embodiment

Figure 1:
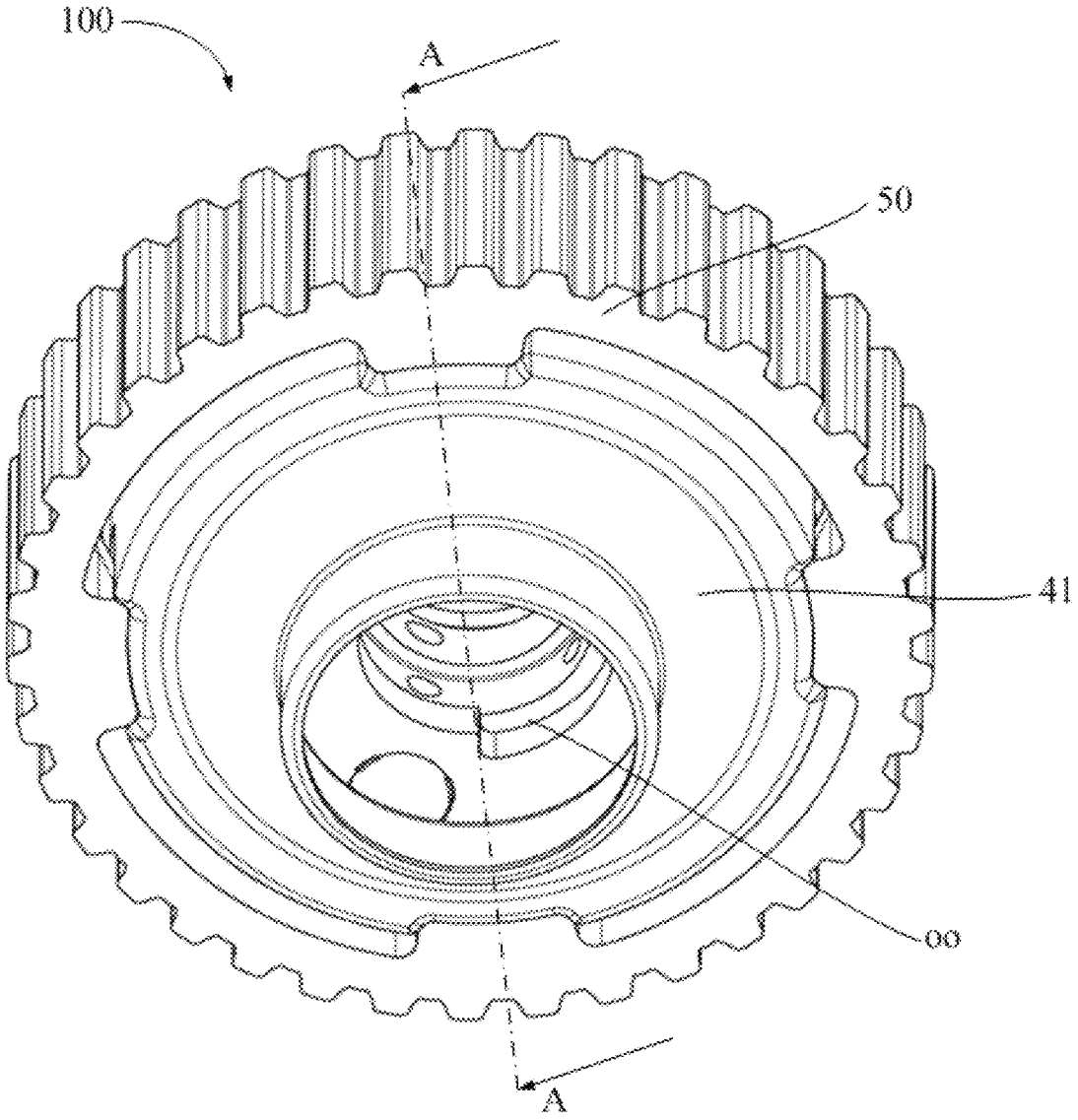
FIG. 1 is a three-dimensional structural diagram of a device for adjusting camshaft phase according to the first embodiment of the present disclosure.
Figure 2:
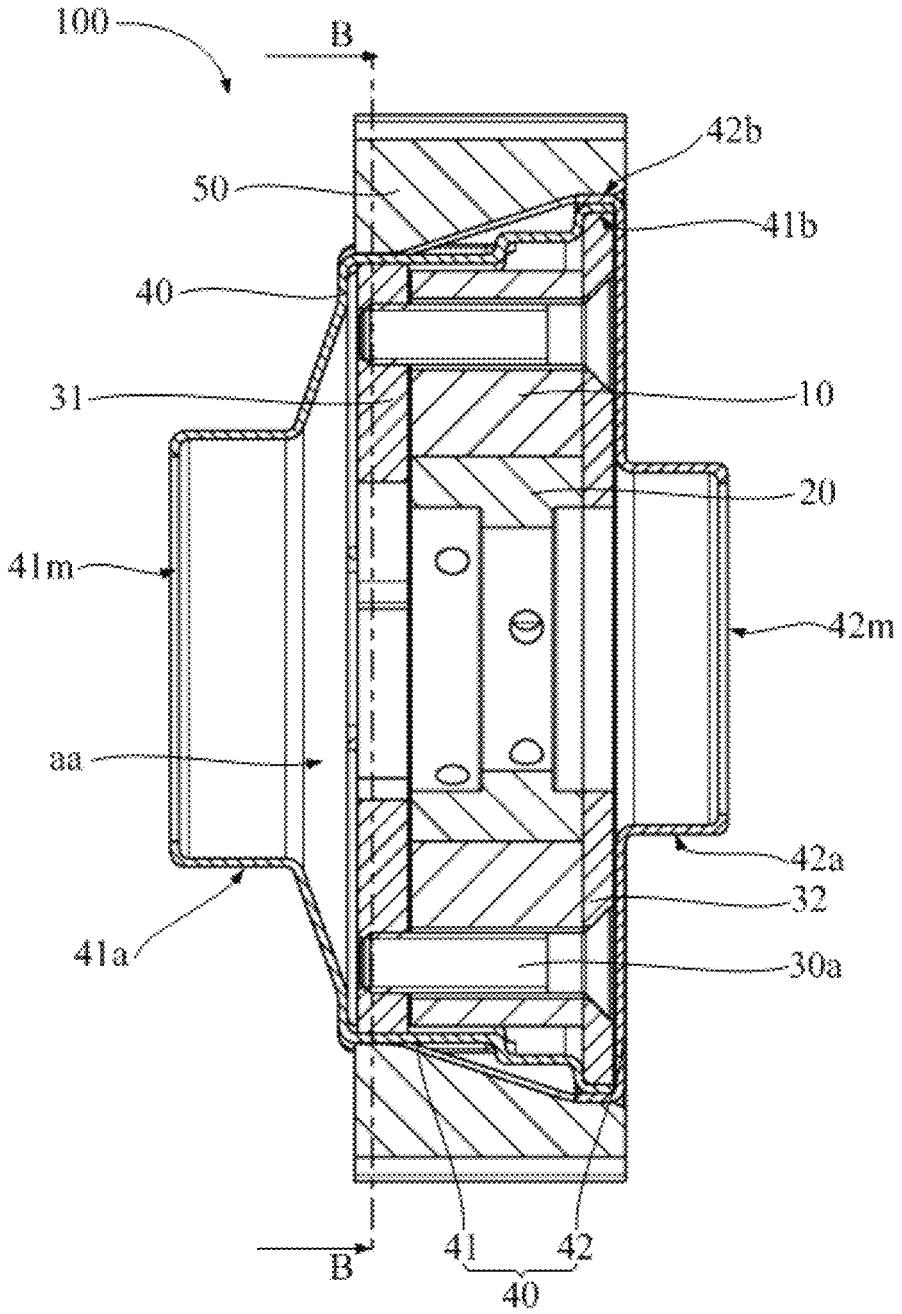
FIG. 2 is a cross-sectional diagram in the direction A-A shown in FIG. 1.
Figure 3:
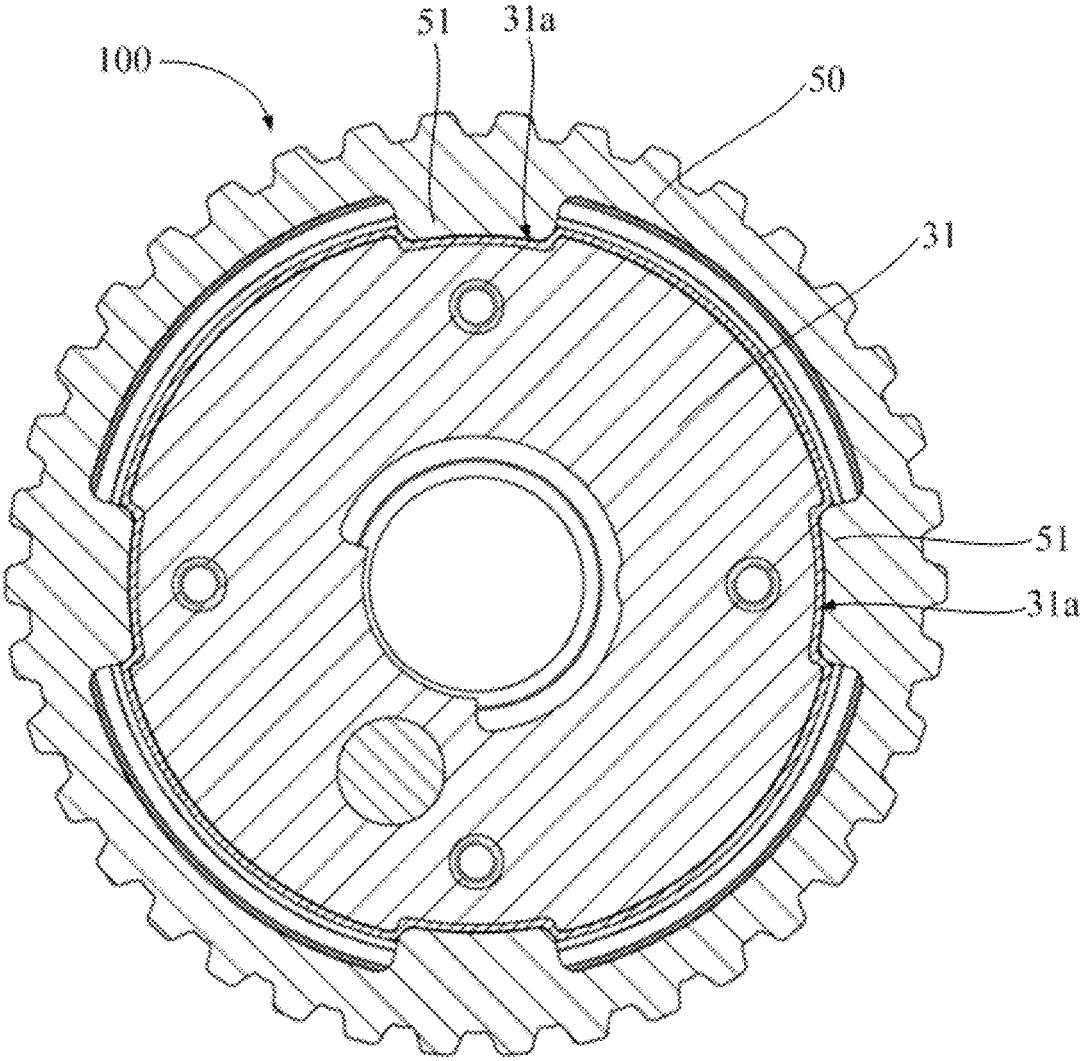
FIG. 3 is a cross-sectional diagram in the direction B-B shown in FIG. 2.

Referring to FIG. 1 to FIG. 3, a device for adjusting camshaft phase 100, commonly referred to as a camshaft phaser, includes a stator 10, a rotor 20, a first guard cap 31, a second guard cap 32, and a belt pulley 50. Wherein, the rotor 20 is disposed inside the stator 10, and the belt pulley 50 is fixedly disposed at the periphery of the stator 10; the belt pulley 50 is connected to the crankshaft of the internal combustion engine through a belt, the rotor 20 is connected to the camshaft of the internal combustion engine; there are a plurality of hydraulic chambers circumferentially distributed between the stator 10 and the rotor 20. The hydraulic chambers are filled with hydraulic oil. By adjusting the oil pressure in different hydraulic chambers, the deflection angle of the rotor 20 relative to the stator 10 can be controlled, so that the deflection angle during the operation between the crankshaft and the camshaft can be adjusted, thereby achieving the adjustment of the timing of valve opening and closing.

The device for adjusting camshaft phase 100 has a central hole oo, a central valve (not shown in the Figure) is adapted to be disposed in the central hole oo, and the central valve provides hydraulic oil to the hydraulic chamber.

The first guard cap 31 and the second guard cap 32 are fixedly arranged at axial sides of the stator 10, and the rotor 20 can be limited between the first guard cap 31 and the second guard cap 32 to prevent the rotor 20 from sliding out of the stator 10 axially. Wherein, the belt pulley 50 is fixedly disposed at the periphery of the first guard cap 31 and the second guard cap 32.

The first guard cap 31 and the second guard cap 32 are respectively fitted to the end surfaces of the axial ends of stator 10, and can prevent the hydraulic oil in the hydraulic chamber from flowing out to the outside to contact the belt pulley 50 and the belt to cause slipping. However, there is inevitably a gap between the the first guard cap 31, the second guard cap 32, and the end surfaces of the stator 10. During the operation of the device for adjusting camshaft phase 100, the hydraulic oil in the hydraulic chamber will still leak from the gap between the guard cap and the end surfaces of the stator.

In addition, the first guard cap 31 and the second guard cap 32 are generally fixed to the stator 10 by screws 30*a*, and the gap between the screws 30*a* and the screwed holes further increases the leakage rate of hydraulic oil.

Moreover, the stator 10 is generally formed of powder metallurgy materials by die-casting. The stator molded by this method has many pores inside, and the hydraulic oil in the hydraulic chamber will also leak from the stator 10 to the outside.

In this embodiment, as shown in FIG. 2, in order to prevent the hydraulic oil from leaking to the outside to contact the belt pulley 50 and the belt to cause slipping, the device for adjusting camshaft phase 100 further includes an annular seal 40, which has a seal body (not shown in the Figure), and a first sealing portion 41*a* and a second sealing portion 42*a* located at axial ends.

Wherein, the first sealing portion 41*a* is provided with a first hole 41*m*, which can cooperate with a corresponding supporting structure (not shown in the Figure) to play a sealing role, preventing the hydraulic oil in the hydraulic chamber from flowing out to the outside; the second sealing portion 42*a* is provided with a second hole 42*m*, which can cooperate with a corresponding supporting structure (not shown in the Figure) to play a sealing role and prevent the hydraulic oil in the hydraulic chamber from flowing out to the outside.

The seal body is fixedly disposed between the stator 10 and the belt pulley 50, extending beyond the first guard cap 31 in the axial direction to connect the first sealing portion 41*a*, and extending beyond the second guard cap 32 in the axial direction to connect the second sealing portion 42*a*.

The seal body, the first sealing portion 41*a* and the second sealing portion 42*a* enclose a sealing cavity aa, and the stator 10, the rotor 20, the first guard cap 31 and the second guard cap 32 are all disposed in the sealing cavity aa, the belt pulley 50 is provided outside the sealed cavity aa. The first sealing portion 41*a* and the second sealing portion 42*a* are located at axial sides of the stator 10 respectively.

Therefore, even if the hydraulic oil in the hydraulic chamber leaks through the gap between the guard cap and the end surface of the stator, or leaks through the stator made by powder metallurgy, the hydraulic oil cannot leak to the outside through the annular seal 40. Therefore, it will not contact the external belt pulley 50 and the belt, and will not cause the belt to slip, reduce the service life of the belt and affect the transmission efficiency of the belt to the crankshaft. According to the present technical solution, it is not necessary to perform resin infiltration treatment on the stator molded by powder metallurgy, which will not greatly increase the cost; moreover, the sealing is in a simple form, no other seals are needed for auxiliary sealing, and the manufacturing process requirements are reduced.

Figure 4:
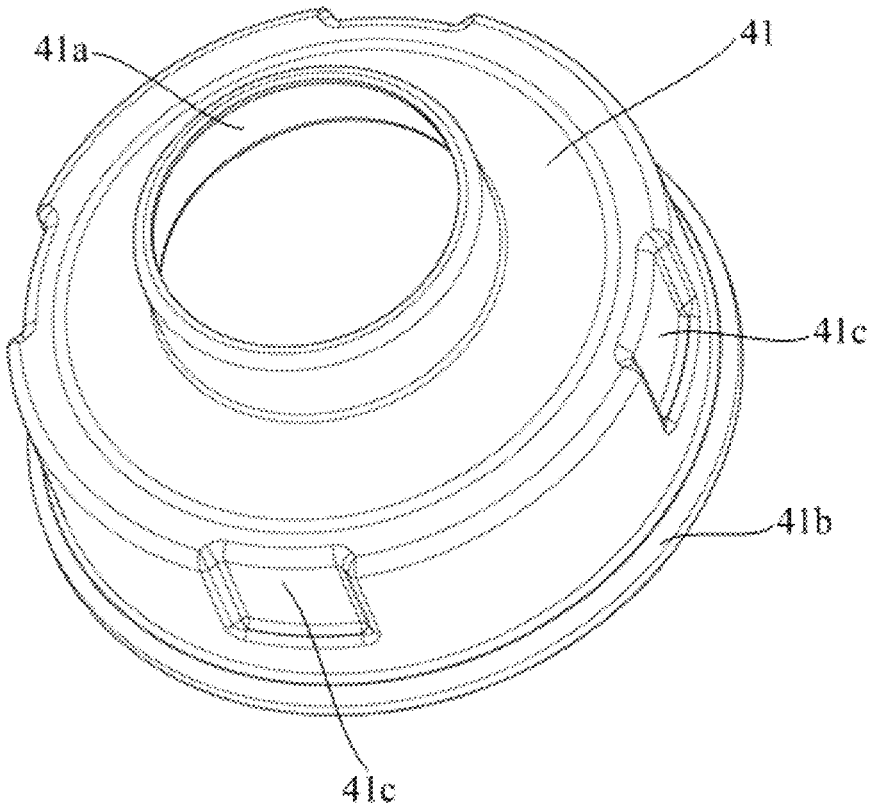
FIG. 4 is a three-dimensional structural diagram of the first seal shown in FIG. 1.
Figure 5:
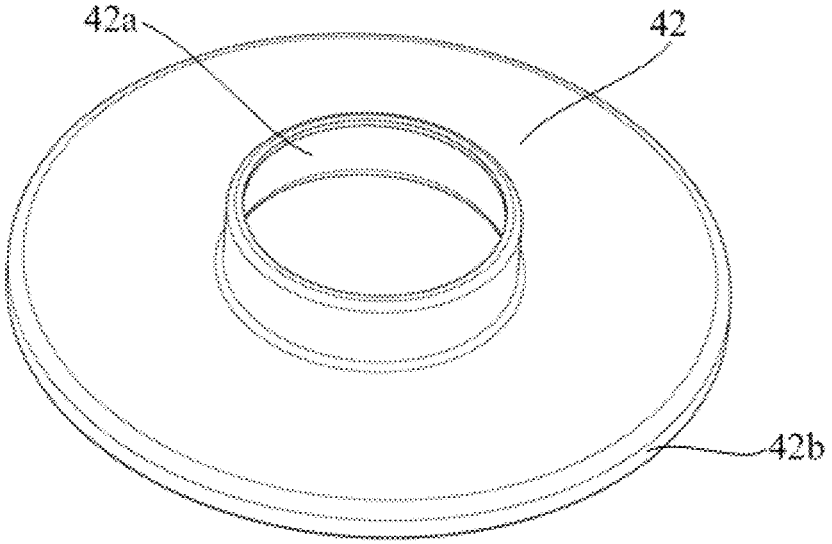
FIG. 5 is a three-dimensional structural diagram of the second seal shown in FIG. 1.

Referring to FIG. 2, and in combination with FIG. 4 and FIG. 5, the annular seal 40 includes a first seal 41 and a second seal 42 arranged sequentially in the axial direction. The first seal 41 surrounds the periphery of the stator 10, the first guard cap 31 and the second guard cap 32. One axial end of the first seal 41 is the first sealing portion 41*a*, and the first sealing portion 41*a* is provided on one axial side of the first guard cap 31; the other axial end of the first seal 41 is the first connection portion 41*b*.

One axial end of the second seal 42 is the second sealing portion 42*a*, and the second sealing portion 42*a* is provided on one axial side of the second guard cap 32; the other axial end of the second seal 42 is the second connection portion 42*b*. The first connection portion 41*b* and the second connection portion 42*b* are connected in a sealed manner to enclose the sealing cavity aa. Specifically, the first connection portion 41*b* and the second connection portion 42*b* are arranged oppositely in the radial direction and fit together to form a contact seal.

The radial dimensions of the first sealing portion 41*a* and the second sealing portion 42*a* are generally smaller than the radial dimensions of the stator 10, the first guard cap 31, and the second guard cap 32. By designing the first seal 41 and the second seal 42, the first seal 41 is fixedly mounted to the stator 10 from the axial side of the first guard cap 31, and the second seal 42 is fixedly mounted to the stator 10 from the axial side of the second guard cap 32, and the first connecting portion 41*b* and the second connecting portion 42*b* are connected in a sealed manner to form the annular seal 40.

Therefore, it can be avoided that the stator 10, the first guard cap 31 and the second guard cap 32 are difficult to be disposed in the seal cavity aa from the first sealing portion 41*a* and the second sealing portion 42*a*, and it is convenient for the installation and manufacture of the device for adjusting camshaft phase 100.

Referring to FIG. 2, the second guard cap 32 extends beyond the outer circumferential face of the stator 10 in the radial direction. Wherein, the first connection portion 41*b* and the second connection portion 42*b* that are arranged radially and oppositely to each other are pressed radially between the belt pulley 50 and the second guard cap 32. As a result, the belt pulley 50 and the second guard cap 32 are interference fitted, and the belt pulley 50 is fixedly connected the second guard cap 32 and the stator 10. The crankshaft of the internal combustion engine drives the belt pulley 50 to rotate through a belt, which drives the stator 10 to rotate. The rotor 20 drives the camshaft to move under the action of hydraulic oil, thereby realizing the function of adjusting the camshaft valve timing.

In addition, since the first connection portion 41*b* and the second connection portion 42*b* are radially pressed between the belt pulley 50 and the second guard cap 32, the radial bonding force between the first connection portion 41*b* and the second connection portion 42*b* is increased, so that the first connection portion 41*b* and the second connection portion 42*b* have a better sealing effect.

Further, the outer circumferential face of the second guard cap 32 and the inner circumferential face of the belt pulley 50 are all in a circular shape, and the first connection portion 41*b* and the second connection portion 42*b* are both in an annulus shape, so that each position of the first connection portion 41*b* and the second connection portion 42*b* in the circumferential direction has a better sealing effect.

It should be noted that, in other variant embodiments, the first connection portion 41*b* and the second connection portion 42*b* may be designed to be pressed radially between the belt pulley 50 and the first guard cap 31, or pressed radially between the belt pulley 50 and the stator 10, which will not affect the implementation of this technical solution.

In addition, in order to have a better sealing effect between the first connection portion 41*b* and the second connection portion 42*b*, a sealant may also be applied on the surface where the first connection portion 41*b* and the second connection portion 42*b* are bonded to further enhance the sealing effect.

Figure 6:
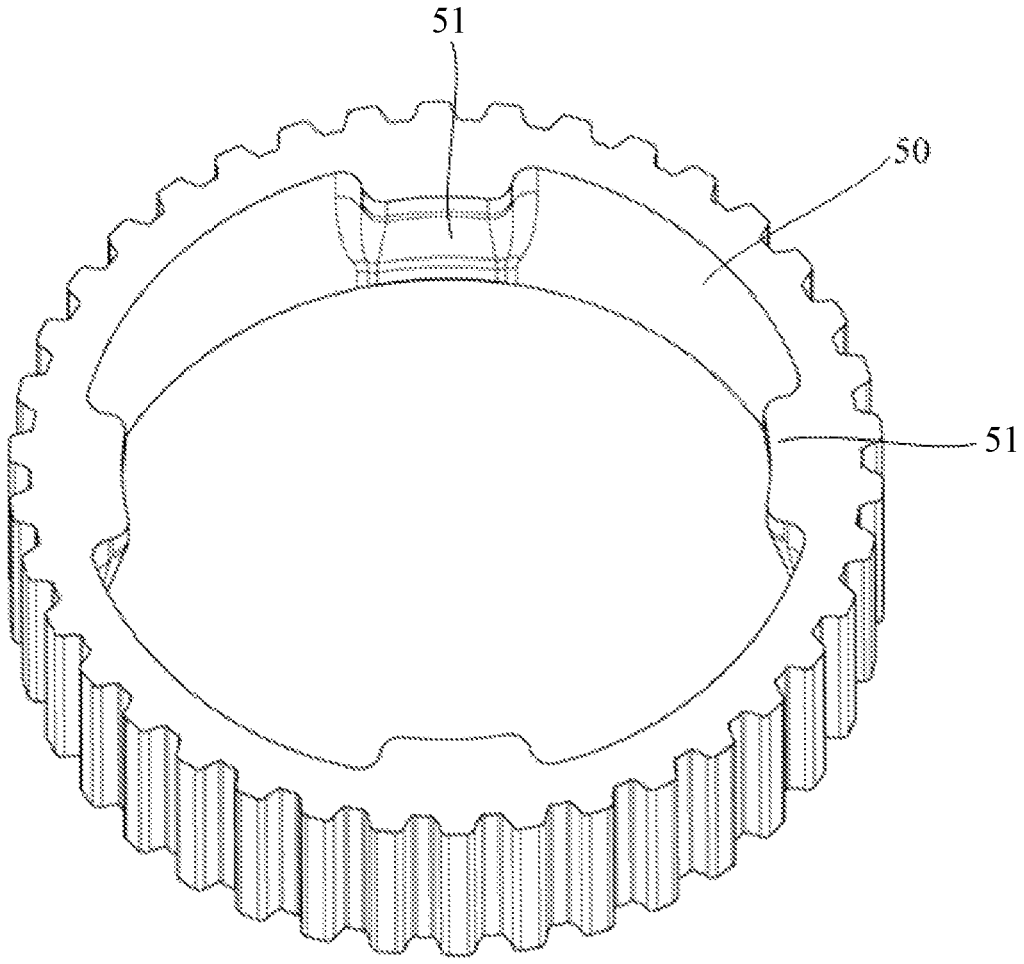
FIG. 6 is a three-dimensional structural diagram of the belt pulley shown in FIG. 1.
Figure 7:
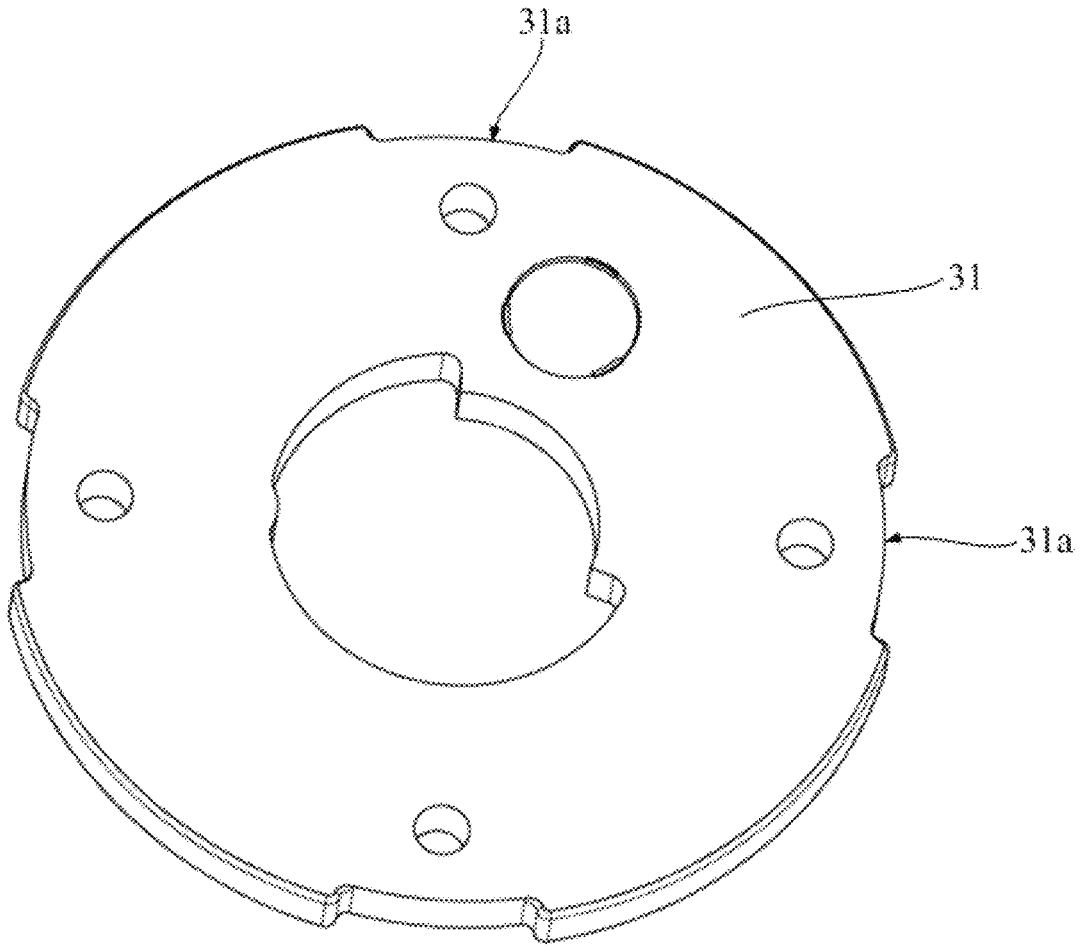
FIG. 7 is a three-dimensional structural diagram of the first guard cap shown in FIG. 1.

Referring to FIG. 3, in combination with FIG. 6 and FIG. 7, the inner circumferential surface of the belt pulley 50 is further provided with a protrusion 51 extending radially inward. The first guard cap 31 extends beyond the outer circumferential surface of the stator 10 in the radial direction, and a groove 31*a* corresponding to the protrusion 51 is provided on the outer circumferential surface of the first guard cap 31, the protrusion 51 extends into the groove 31*a*.

Therefore, the groove 31*a* can limit the protrusion 51 in the circumferential direction, and the torque can be well transmitted to the stator 10 when the belt pulley 50 rotates, so as to improve the stressing state during the operation of the device for adjusting camshaft phase 100.

Further, the protrusion 51 and the groove 31*a* are interference fitted, so that relative rotation between the belt pulley 50 and the first guard cap 31 in the circumferential direction can be avoided, the acting force of the belt pulley 50 can be well transmitted to the first guard cap 31.

As shown in FIG. 3, there are a plurality of protrusions 51, which are evenly distributed in the circumferential direction; correspondingly, there are a plurality of grooves 31*a*, which are evenly distributed in the circumferential direction. The protrusions 51 and the grooves 31*a* are provided in one-to-one correspondence to better transmit the torque.

As shown in FIG. 4, since the protrusion 51 is provided on the inner surface of the belt pulley 50, the first seal 41 is provided among the belt pulley 50, the stator 10, the first guard cap 31 and the second guard cap 32. A recess 41*c* is provided on an outer surface of the first seal 41 corresponding to the protrusion 51, and the protrusion 51 is inserted into the recess 41*c*.

Specifically, there are a plurality of recesses 41*c*, which are evenly distributed in the circumferential direction, and the recesses 41*c* are all located between the protrusions 51 and the grooves 31*a* correspondingly disposed.

The groove of this embodiment is formed on the outer surface of the first guard cap 31. In other variant embodiments, a groove matching the protrusion 51 may also be formed on the outer surface of the stator 10, or a groove matching with the protrusion 51 may be formed on the outer surface of the second guard cap 32, which can also better transmit the torque.

In addition, a groove may also be provided on the inner circumferential surface of the belt pulley 50, and a protrusion may be provided on at least one outer surface of the first guard cap 31, the second guard cap 32 and the stator 10, so that the protrusion cooperates with the groove to transmit torque, which will not affect the implementation of this technical solution.

Continuously referring to FIG. 2 and FIG. 6, in this embodiment, the height of the protrusion 51 gradually increases from one axial end to the other end of the belt pulley 50. That is, the size of the inner circumferential surface of the belt pulley 50 gradually decreases from one axial end to the other end of the belt pulley 50.

The size of the outer circumferential surface of the first guard cap 31 is slightly smaller than the size of the outer circumferential surface of the second guard cap 32.

In the process of manufacturing the device for adjusting camshaft phase 100, the first seal 41 is firstly fixed to the first guard cap 31 and the second guard cap 32 from the side where the first guard cap 31 is located; then the second seal 42 is fixed to the second guard cap 32 from the side where the second guard cap 32 is located, and the first connection portion 41*b* and the second connection portion 42*b* are disposed radially and oppositely to each other.

At this time, the first connection portion 41*b* and the second connection portion 42*b* that are arranged radially and oppositely to each other may be closely fitted and sealed, or there may be a small gap between the first connection portion 41*b* and the second connection portion 42*b* to be pressed and sealed by the use of the belt pulley 50.

Finally, the stator 10, the first guard cap 31, the second guard cap 32, the first seal 41, and the second seal 42 as a whole are inserted into the belt pulley 50 in the axial direction. The second guard cap 32 is interference fitted with the belt pulley 50 to complete the fixing of the belt pulley 50 and the second guard cap 32. At this time, the belt pulley 50 and the second guard cap 32 press against the first connection portion 41*b* and the second connection portion 42*b*, increasing the radial bonding force between the first connection portion 41*b* and the second connection portion 42*b*, and improving the sealing effect.

The above-mentioned assembling method is relatively simple, without using bolts or screws for fixed connection, which can reduce the number of components and the size of the device for adjusting camshaft phase 100.

In addition, since the belt pulley 50 and the second guard cap 32 are interference fitted to complete the fixing, the machining accuracy requirements of the second guard cap 32 and the belt pulley 50 can be reduced to a greater extent. The first guard cap 31 may be interference fitted with the belt pulley 50 or may be clearance fitted, which can further reduce the machining accuracy requirements of the first guard cap 31.

The Second Embodiment

In the first embodiment, the first connection portion 41*b* and the second connection portion 42*b* are arranged radially and oppositely to each other and are snugly sealed. The sealed fitting surface is an annular curved surface.

Figure 8:
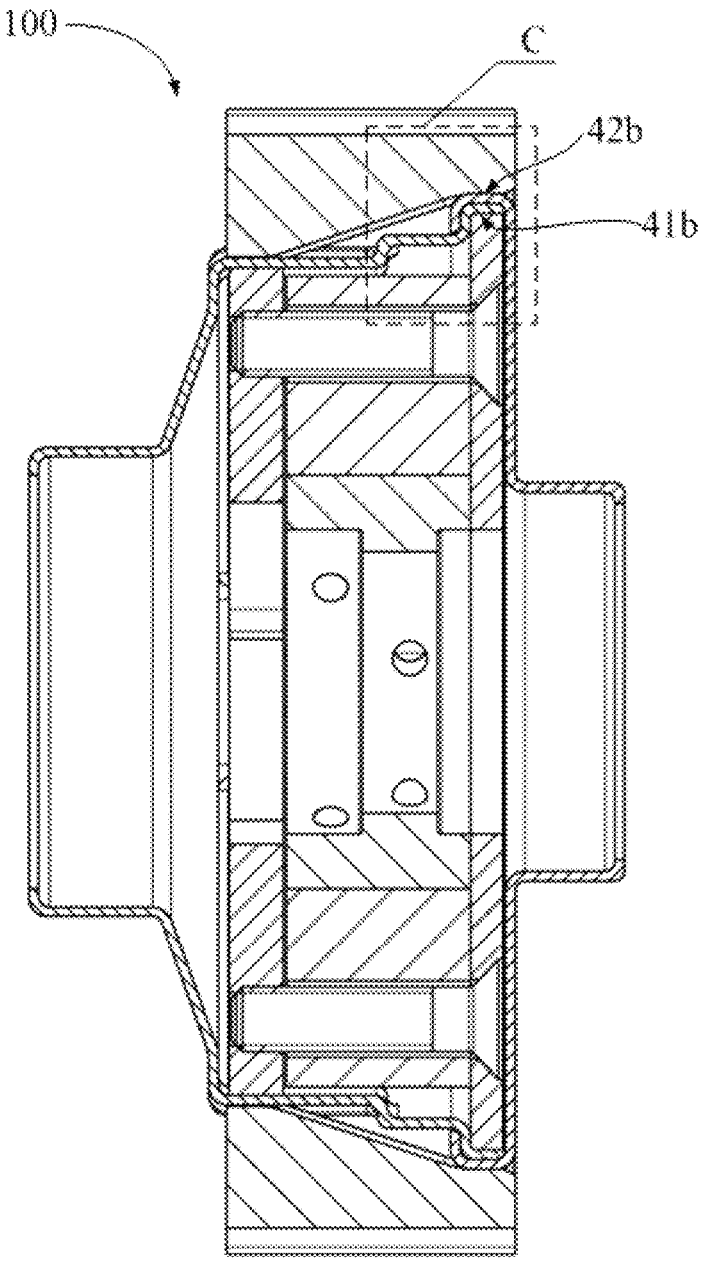
FIG. 8 is a three-dimensional structural diagram of a device for adjusting camshaft phase according to the second embodiment of the present disclosure.
Figure 9:
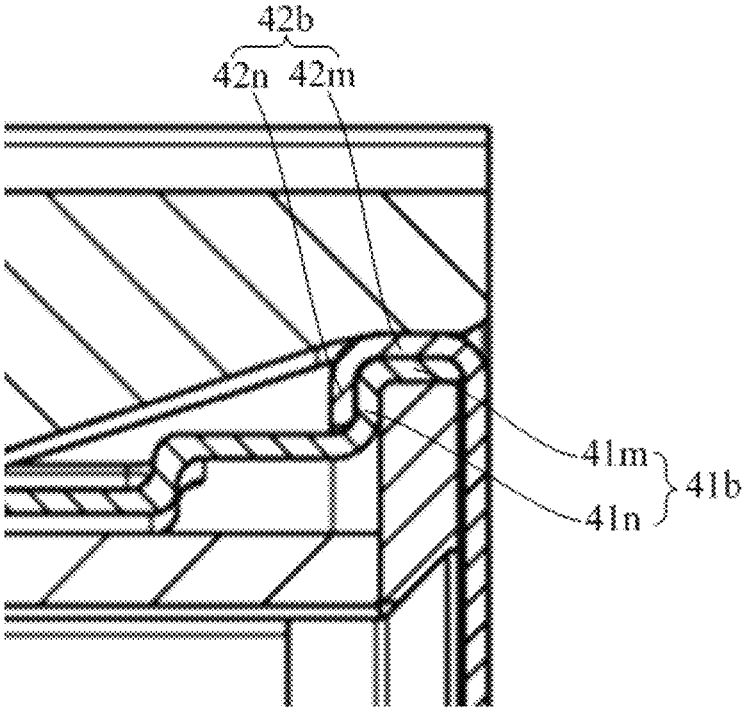
FIG. 9 is an enlarged view of the area C shown in FIG. 8.

Referring to FIG. 8 and FIG. 9, this embodiment differs from the first embodiment in that:

the first connection portion 41*b* includes a first portion 41*m* extending in the axial direction and a second portion 41*n* extending in the radial direction; and the second connection portion 42*b* includes a third portion 42*m* extending in the axial direction and a fourth portion 42*n* extending in the radial direction.

Wherein, the first portion 41*m* and the third portion 42*m* are arranged radially and oppositely to each other and are snugly sealed, and have a first sealed fitting surface; and the second portion 41*n* and the fourth portion 42*n* are arranged radially and oppositely to each other and are snugly sealed, and have a second sealed fitting surface.

By providing two sealed fitting surfaces between the first connection portion 41*b* and the second connection portion 42*b*, the first connection portion 41*b* and the second connection portion 42*b* have a better sealing effect, so that the hydraulic oil is less likely to flow out to the outside.

In other variant embodiments, the first connection portion 41*b* and the second connection portion 42*b* may have more sealed fitting surfaces therebetween. The more the sealed fitting surfaces, the better the sealing effect between the first connection portion 41*b* and the second connection portion 42*b*.

The Third Embodiment

Figure 10:
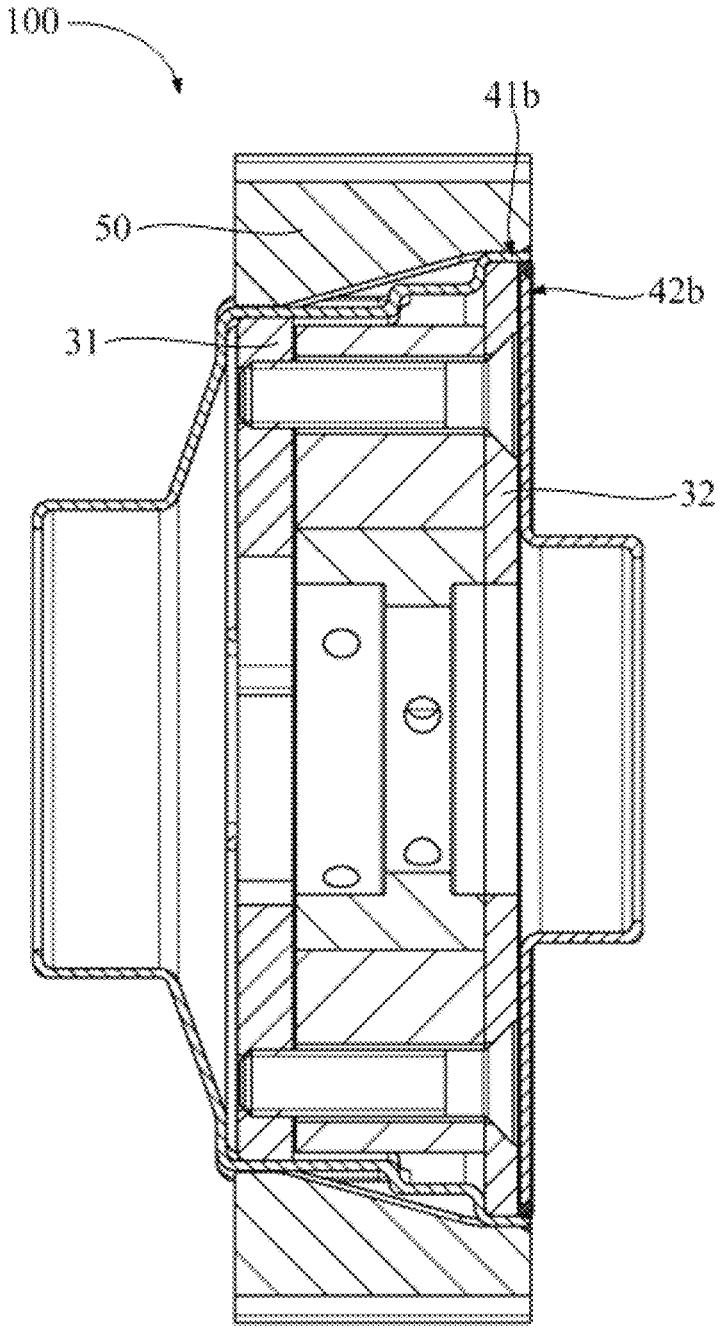
FIG. 10 is a three-dimensional structural diagram of a device for adjusting camshaft phase according to the third embodiment of the present disclosure; and, FIG. 11 is a three-dimensional structural diagram of a device for adjusting camshaft phase according to the fourth embodiment of the present disclosure.

Referring to FIG. 10, this embodiment differs from the first embodiment in that: the first connection portion 41*b* and the second connection portion 42*b* are weldedly sealed.

Specifically, only the first connection portion 41*b* is radially pressed between the belt pulley 50 and the second guard cap 32, and extends to the axial side of the second guard cap 32; the second connection portion 42*b* is located on the axial side of the second guard cap 32, and is weldedly sealed with the part of the first connection portion 41*b* that extends beyond the second guard cap 32.

It should be noted that the welding positions of the first connection portion 41*b* and the second connection portion 42*b* are not limited to the case of this embodiment. In other variant embodiments, the welding position may be on the side where the first guard cap 31 is located, also may be between the first guard cap 31 and the second guard cap 32, which will not affect the implementation of this technical solution.

The Fourth Embodiment

Figure 11:
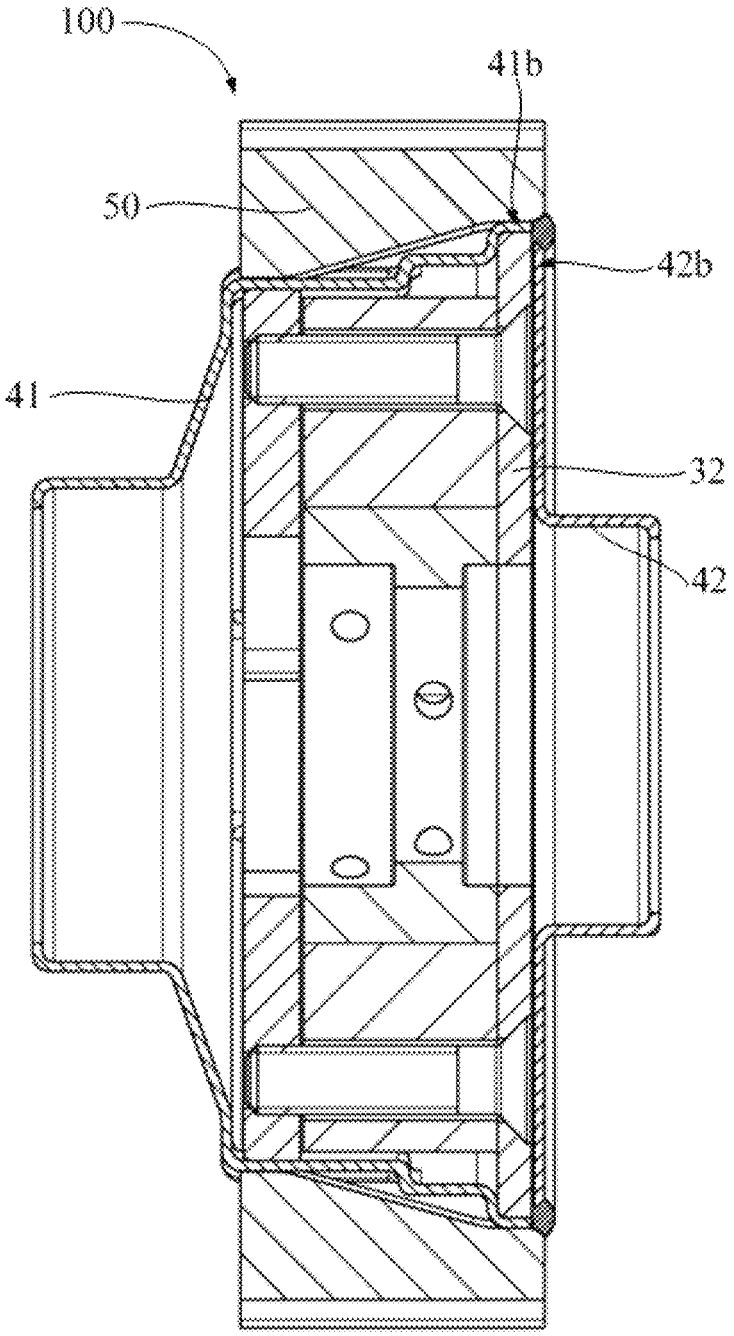

Referring to FIG. 11, this embodiment differs from the third embodiment in that: the first connection portion 41*b* and the second connection portion 42*b* are weldedly fixed to the belt pulley 50.

Therefore, by weldedly fixing the first connection portion 41*b* and the second connection portion 42*b* to the belt pulley 50, a fixed connection between the first seal 41, the second seal 42 and the belt pulley 50 can be achieved. At this time, it can be avoided that the belt pulley 50 falls off due to insufficient interference force between the second guard cap 32 and the belt pulley 50 or the belt pulley 50 being under the vibratory action of the belt.

In this embodiment, the first connection portion 41*b* and the second connection portion 42*b* are weldedly sealed.

In other variant embodiments, the first connection portion 41*b* and the second connection portion 42*b* may also be in a contact seal way. For details, refer to the first embodiment or the second embodiment. After the installation is completed, the first seal 41 and the belt pulley 50 are welded; or, the second seal 42 and the belt pulley 50 are welded to realize the fixed connection between the first seal 41, the second seal 42 and the belt pulley 50.

Although the present disclosure is disclosed as above, the present disclosure is not limited thereto. Any person skilled in the art can make various changes and modifications without departing from the spirit and scope of the present disclosure. Therefore, the protection scope of the present disclosure should be subject to the scope defined by the Claims.

The invention claimed is:

1. A camshaft phaser, comprising:

a stator;

a rotor provided in the stator;

a first guard cap fixed to a first axial end of the stator and a second guard cap fixed to a second axial end of the stator, the first and second guard caps configured to limit axial movement of the rotor with respect to the stator;

a belt pulley fixed to at least one of the stator, the first guard cap, or the second guard cap such that the belt pulley is arranged on a periphery of the stator and the first and second guard caps; and an annular seal assembly arranged radially between the stator and the belt pulley, the annular seal assembly including a first seal and a second seal respectively defining first and second axial ends of the annular seal assembly, the annular seal assembly configured to prevent leakage of hydraulic fluid to the belt pulley wherein the first seal extends axially beyond the first guard cap and the second seal extends axially beyond the second guard cap.

2. The camshaft phaser of claim 1, wherein, the first seal has a first hole in a first sealing portion, the second seal has a second hole in a second sealing portion, the first and second holes are coaxially aligned with the stator, and a first diameter of the first hole and a second diameter of the second hole are each less than respective diameters of the stator, the first guard cap, and the second guard cap.

3. The camshaft phaser of claim 2, wherein at least one of the first sealing portion or the second sealing portion is adapted to form a seal to prevent leakage of hydraulic fluid to the belt pulley.

4. The camshaft phaser of claim 1, wherein the first seal and the second seal are welded together.

5. The camshaft phaser of claim 1, wherein the first seal and the second seal are fitted together via engagement of respective first and second sealed fitting surfaces.

6. The camshaft phaser of claim 1, wherein the first seal has a first connection portion and the second seal has a second connection portion, the first connection portion and the second connection portion are radially opposed to each other, so as to be radially pressed between the belt pulley and the stator.

7. The camshaft phaser of claim 1, wherein at least one of the first seal or the second seal is welded to the belt pulley.

8. The camshaft phaser of claim 1, further comprising a protrusion formed on one of the belt pulley or the stator, and a remaining one of the belt pulley or the stator is formed with a groove configured to receive the protrusion.

9. The camshaft phaser of claim 8, wherein the protrusion is formed on an inner circumferential surface of the belt pulley, and a height of the protrusion gradually increases from a first axial end of the belt pulley to a second axial end of the belt pulley.

10. The camshaft phaser of claim 8, wherein the first guard cap and the second guard cap each extend beyond an outer circumferential surface of the stator in a radial direction, and the groove is provided on at least one of the first guard cap or the second guard cap.

11. The camshaft phaser of claim 7, wherein the groove and the protrusion form an interference fit.

12. The camshaft phaser of claim 1, wherein the first seal has a first connection portion and the second seal has a second connection portion, the first connection portion and the second connection portion are radially opposed to each other, so as to be pressed radially between the belt pulley and the second guard cap.

13. The camshaft phaser of claim 1, further comprising a protrusion formed on one of the belt pulley or the first guard cap, and a remaining one of the belt pulley or the first guard cap is provided with a groove configured to receive the protrusion.

14. A camshaft phaser, comprising:

a stator;

a rotor provided in the stator;

a first guard cap fixed to a first axial end of the stator and a second guard cap fixed to a second axial end of the stator, the first and second guard caps configured to limited axial movement of the rotor with respect to the stator;

a belt pulley fixed to at least one of the stator, the first guard cap, or the second guard cap such that the belt pulley is arranged on a periphery of the stator and the first and second guard caps; and an annular seal assembly arranged radially between the stator and the belt pulley, the annular seal assembly including a first seal and a second seal respectively defining first and second axial ends of the annular seal assembly, the first and second seals configured to be pressed together so as to form a sealing cavity configured to enclose the stator, the rotor and the first and second guard caps such that hydraulic fluid is prevented from leaking to the belt pulley.

15. The camshaft phaser of claim 14, wherein the first guard cap and the second guard cap each extend beyond an outer circumferential surface of the stator in a radial direction.

16. The camshaft phaser of claim 14, wherein an outer diameter of the first guard cap is less than an outer diameter of the second guard cap.

17. The camshaft phaser of claim 14, wherein the annular seal assembly surrounds at least three sides of at least one of the first guard cap or the second guard cap.

18. The camshaft phaser of claim 14, wherein the first and second seals are configured to be pressed together via the belt pulley.

19. A camshaft phaser, comprising:

a stator;

a rotor provided in the stator;

a first guard cap fixed to a first axial end of the stator and a second guard cap fixed to a second axial end of the stator, the first and second guard caps configured to limit axial movement of the rotor with respect to the stator;

a belt pulley fixed to at least one of the stator, the first guard cap, or the second guard cap such that the belt pulley is arranged on a periphery of the stator and the first and second guard caps; and an annular seal assembly arranged radially arranged between the belt pulley and the stator; the annular seal assembly including a first seal and a second seal respectively defining first and second axial ends of the annular seal assembly which are fit together so as to form an enclosed sealing cavity configured to prevent leakage of hydraulic fluid to the belt pulley wherein the first and second seals are configured to be pressed and fixed to the second guard cap via the belt pulley.

20. The camshaft phaser of claim 19, wherein the annular seal assembly is formed by: i) a first radial surface of the first seal configured to seal against a second radial surface of the second seal; and, ii) a third axial surface of the first seal configured to seal against a fourth axial surface of the second seal.

* * * * *